US005855764A

United States Patent [19]

Greaney et al.

[11] Patent Number: 5,855,764

[45] Date of Patent: Jan. 5, 1999

[54] METHOD FOR DEMETALLATING PETROLEUM STREAMS

[75] Inventors: Mark Alan Greaney, Upper Black Eddy, Pa.; William Neergaard Olmstead, Murray Hill, N.J.

[73] Assignee: Exxon Research and Engineering Company, Florham Park, N.J.

[21] Appl. No.: 900,391

[22] Filed: Jul. 15, 1997

[51] Int. Cl.[6] ..... C10G 32/00

[52] U.S. Cl. ..... 205/688; 205/695; 205/696; 205/702

[58] Field of Search ..... 205/688, 695, 205/702, 696

[56] References Cited

U.S. PATENT DOCUMENTS

| | | | |
|---|---|---|---|
| 3,457,152 | 7/1969 | Maloney, Jr. et al. | 205/131 |
| 5,102,510 | 4/1992 | Darian et al. | 204/59 R |
| 5,246,553 | 9/1993 | Harrison et al. | 204/140 |
| 5,529,684 | 6/1996 | Greaney et al. | 205/688 |

OTHER PUBLICATIONS

Branthaver, Western Research Institute, Chapter 12, American Chemical Society, pp. 188–204 (1987) (no month).

Ovalles et al, "Upgrading of Orinoco Belt crude oil and its fractions by an electrochemical system in the presence of protonating agents", Fuel Processing Technology 48, pp. 159–172 (1996) (no month).

*Primary Examiner*—Arun S. Phasge
*Attorney, Agent, or Firm*—Linda M. Scuorzo

[57] ABSTRACT

The present invention provides for a method of decreasing the metals content of metal containing petroleum streams by forming a mixture of the petroleum fraction containing those metals and an aqueous electrolysis medium containing electron transfer agent, and passing an electric current through the mixture or through the pretreated aqueous electrolysis medium at a voltage, sufficient to remove the metals such as Ni, V and Fe from the stream (i.e. to produce a petroleum fraction having decreased content of the metals). The cathodic voltage is from 0 V to −3.0 V vs. SCE. The invention provides a method for enhancing the value of petroleum feeds that traditionally have limited use in refineries due to their metals, e.g., Ni and V content.

9 Claims, 1 Drawing Sheet

METHOD FOR DEMETALLATING PETROLEUM STREAMS

FIELD OF THE INVENTION

The present invention relates to a method for electrochemically demetallating refinery feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see e.g., Branthaver, Western Research Institute in Ch. 12, "Influence of Metal Complexes in Fossil Fuels on Industrial Operations", Am. Chem. Soc. (1987)). Such metals, for example, act as poisons for hydroprocessing and fluid catalytic cracking catalysts, thereby, shortening the run length of such processes, increasing waste gas make and decreasing the value of coke product from coker operations.

The presence of such metals prevents more advantageous use of the petroleum stream by rendering especially the heaviest oil fractions (in which these metal containing structures most typically occur) less profitable to upgrade, and when these resources are used they make catalyst replacement/disposal expensive. Current refinery technologies typically address the problem by using metal containing feedstreams as a less preferred option, and by tolerating catalyst deactivation when there are not other feedstream alternatives available.

Electrochemical processes have been used for removal of halogenated organic compounds, e.g., polychlorinated biphenyls in one phase organic systems see e.g., U.S. Pat. No. 5,102,510 and for removal of water soluble metals from aqueous streams, see e.g., U.S. Pat. No. 3,457,152. Petroleum streams are typically not halogen containing. Removal of metals from complex petroleum streams is more difficult because the metals are associated with hydrocarbon species, and are not readily water soluble. U.S. Pat. No. 5,529,684 discloses a process for electrochemically demetallating petroleum streams, but there is a continuing need for an effective method for removal of these metals particularly ones in which enhanced rates of demetallation, at higher current efficiencies and/or lower electrolyte concentrations are possible. Applicants' invention addresses this need.

SUMMARY OF THE INVENTION

The present invention provides for a method for removing metals, preferably Ni and V, from petroleum streams containing these metals. In one embodiment the process provides for a process for demetallating a petroleum stream, by applying to an oil in water dispersion of a hydrocarbon soluble metals-containing petroleum stream and an aqueous electrolysis medium containing at least one electron transfer agent and at least one electroconductive salt a sufficient electric current to produce a petroleum stream having a decreased metals content. In another embodiment the invention provides for a process for demetallating a petroleum stream by contacting an aqueous electrolysis medium containing at least one electron transfer agent and at least one electronconductive salt with a sufficient electrical current to produce a treated aqueous electrolysis medium containing a reduced electron transfer agent; and contacting the treated aqueous electrolysis medium of step (a) with a metals-containing petroleum stream for a time sufficient to produce a petroleum stream having a decreased metals content.

The process may also be used to remove metals, such as Fe, that are more easily removed than Ni and V.

The present invention may suitably comprise, consist or consist essentially of the described elements and may be practiced in the absence of an element not disclosed.

DETAILED DESCRIPTION OF THE INVENTION

The present invention provides for a method for decreasing the content of metals (particularly those typically associated with hydrocarbon species and thus hydrocarbon soluble) of a hydrocarbonaceous petroleum stream by subjecting a mixture or dispersion of the petroleum stream (also referred to herein as a fraction or feed) containing the metals and water, and at least one electroconductive, preferentially water soluble salt, and at least one preferentially water soluble or solubilizable electron transfer agent to an electric current for a time and at conditions sufficient to remove the metals from the stream (i.e., to produce a treated petroleum fraction having decreased content of the metals). Metals removal occurs from the petroleum (i.e., oil) phase. The contacting is carried out under conditions to result in passing of an electric current therethrough.

The metallic components that may be treated include Ni and V species, as these are typically present in petroleum streams. Transition metals such as Ni and V are often found, for example, in porphyrin and porphyrin-like complexes or structures, and are abundant in heavy petroleum fractions. In these feeds such metal species tend to be found in non-water soluble or immiscible structures. Iron also may be removed by the process.

Water soluble metal salts typically can be removed from petroleum streams using electrostatic desalter processes, which entail applying an electric field to aid in separation of water and petroleum phases. The water soluble metal salts are thereby extracted and removed from the petroleum streams. By contrast to the present invention, in a desalter, high voltage is applied in the absence or essential absence of current flow and the metals that are removed are essentially not hydrocarbon soluble. However, hydrocarbon soluble metals components of petroleum streams are more difficult to treat. Petroleum streams are complex mixtures of many different types of reactive and unreactive species. As such the ability to successfully treat particular components of petroleum streams or fractions is not readily predictable from the reactivity of and success in treating pure components.

The process of this invention also may be applied to the removal of metals that are more easily reduced than Ni and V, such as Fe. However, since other processing options are available for removal of such other metals, the process is most advantageous for removal of the metals Ni, V, as these are typically more costly to remove. A benefit of the process of the present invention is in its ability to remove metals contained in typically non-water extractable metals containing moieties, at lower concentrations of salts and at higher current efficiencies than in current processes.

Examples of Ni and V metal-containing petroleum streams or fractions that may be treated according to the process of the present invention are metal containing carbonaceous and hydrocarbonaceous petroleum streams of fossil fuels such as crude oils and bitumens, as well as processed/distilled streams (distillation residues) such as atmospheric and vacuum resids, fluid catalytic cracker feeds, metal containing deasphalted oils and resins, processed resids and heavy oils (heavy crudes) as these typically have a high metals content.

The feed to be demetallated can have a range of metals content. The average vanadium in the feed is typically about 5 ppm to 2,000 ppm, preferably about 20 to 1,000 ppm, by weight most preferably about 20 to 100 ppm. The average nickel content in the starting feed is typically about 2 to 500 ppm, preferably about 2 to 250 ppm by weight most preferably about 2 to 100 ppm. For example, a Heavy Arab crude distillate having an initial cut point of 950° F. (510° C.) and a final cut point of 1160° F. (627° C.) may have a typical nickel content of 8 ppm and a vanadium content of 50 ppm by weight. However, any level of nickel and/or vanadium may be treated according to the present invention.

The metal containing petroleum feed to be treated preferably should be in a liquid or fluid state at process conditions. This may be accomplished by heating the material or by treatment with a suitable solvent as needed. This assists in maintaining the mixture of the metal containing petroleum stream and aqueous electrolysis medium containing the electron transfer agent and salt in a fluid form to allow passage of an electric current. Current densities of 1 $mA/cm^2$ of cathode surface or greater area are suitable.

Preferably the oil droplets should be of sufficient size to enable the metals containing components to achieve intimate contact with the electron transfer agent in the aqueous electrolysis medium. Droplet size particles of about 0.1 micron to 1.0 mm, for example are suitable. Desirably the process should be carried out for a time and at conditions within the ranges disclosed sufficient to achieve a decrease, preferably a maximum decrease, in content of the metals. Contacting is typically accomplished by intimate mixing of the metal containing petroleum stream and the aqueous electrolysis medium (which contains the electrolyte salt and either the pretreated, i.e., reduced electron transfer agent, or the untreated electron transfer agent, depending on the embodiment of the invention) to form a mixture or oil-in-water dispersion (i.e., with the aqueous phase containing the electron transfer agent and electrolyte salt as the continuous phase), for example using a stirred batch reactor or turbulence promoters in flowing cells.

Unexpectedly, introducing into the system a relatively small quantity of one or more compounds which are effective to increase the rate and/or efficiency of electron transfer can potentially increase the rate of demetallation. These species or compounds are referred to herein as electron transfer agents. These agents undergo reversible electrochemical reduction-oxidation (i.e., are redox active).

The electrochemical cell is typically equipped with at least two oppositely charged electrodes including cathodes (working electrodes) and anodes (counter electrodes) with electrolyte in the system to complete the cell circuitry for operation of the cell. For example, a plurality of working electrodes and counterelectrodes placed in a pack may be employed. The electrochemical cell can optionally include a reference electrode placed between the working and counter electrodes to monitor desired working electrode voltages during the electrochemical demetallation reaction.

Electrode materials useful in accordance with the present process should be resistant to degradation by and dissolution in the materials and salts employed during the electrochemical process. Such materials should also be stable under the electrical field imposed thereon. Suitable materials which can be used as working electrodes are those which will support the electrochemical demetallation, and which are preferably stable and inexpensive include lead, cadmium, zinc, tin, mercury and alloys thereof, and carbon, and other materials suitable for removal of metals, e.g., Ni and V. Other suitable electrodes known in the art may be used for removal of other metals. Included as suitable electrodes are three-dimensional electrodes, such as carbon or metallic foams. Suitable materials which can be used as counterelectrodes should be resistant to degradation and corrosion in the presence of the products produced in the electrochemical process. Other conventional electrodes known to those skilled in the art which are stable in aqueous solutions containing an electrolyte salt and electron transfer agent of the types used herein may be used.

As set forth above, the present inventive process is carried out in an electrochemical cell containing an aqueous electrolysis medium that is capable of conducting electric current and supporting the electrochemical demetallation in the presence of an electroconductive salt and an electron transfer compound. The aqueous electrolysis medium is the continuous phase in the present electrochemical process and is contacted with the metals-containing petroleum stream as the dispersed phase in the aqueous electrolysis medium.

The salt and electron transfer agent should be sufficiently soluble or solubilizable in the aqueous electrolysis medium to provide sufficient conductivity and reaction rates.

Materials useful as electron transfer agents are capable of undergoing reversible electrochemical reduction/oxidation during demetallation of the petroleum stream, and are sufficiently soluble or solubilizable in the aqueous electrolysis medium to provide the desired reaction rate. Some representative examples of compounds include organic, organometallic and inorganic species.

The electron transfer agents can be any water soluble or water solubilizable chemical species which shows reversible electrochemical redox behavior within the potential range of 0 to −3.0 V vs. SCE. One normally skilled in the art would recognize that this is suitably determined for a material by measuring the species' cyclic voltamograms in an aqueous electrolyte and determining if the species exhibits reversible electrochemical redox in this potential range. In the process of the present invention, the electron accepted by the electron transfer agent would not be donated to the anode during electrolysis, but rather to species to be treated within the petroleum stream. Chemical species which could be considered as electron transfer agents for the process include both organic species and metal complexes which undergo reversible redox as described above. For example, in the organic category are species such as quinones, anthroquinones, benzoquinones, naphthaquinones, xanthones, phthallic acids, sulfonates, tosylates, carboxylates and benzophenones with suitable substituents to assist in water solubility and to tune the redox properties to the desired potential range. Many types of metal complexes could be considered for this process, such as trisbipyridyl, trisphenanthroline and dithiocarbamate complexes of transition metals. Derivatization of ligands to increase water solubility and to affect redox potentials could be conducted by one normally skilled in the art. A wide range of potential electron transfer agents are possible, limited only by their water solubility or solubilizability and their reversible redox behavior in the desired potential range.

The ratio of electron transfer agent to salt can be chosen by one skilled in the art to influence both the demetallation rate and efficiency depending upon the particular materials used, their concentrations and processing conditions.

The electrolyte salt in the aqueous electrolysis medium is desirably a salt that dissolves or dissociates in water to produce electrically conducting ions, but that does not undergo redox in the range of applied potentials used.

Suitable organic electrolytes include quaternary carbyl and hydrocarbyl onium salts, e.g., alkylammonium salts. Inorganic electrolytes include, e.g., NaOH, KOH and sodium phosphates. Mixtures thereof also may be used. Suitable onium ions include mono- and bis-phosphonium, sulfonium and ammonium. Carbyl and hydrocarbyl moieties are preferably alkyl. Quaternary alkylammonium ions include tetramethylammonium, tetraethylammonium and tetrabutylammonium. Optionally, additives known in the art to enhance performance of the electrodes or the system may be added such as surfactants, detergents, emulsifying agents and anodic depolarizing agents.

Typically a concentration of salt 1–50 wt % in the aqueous electrolysis medium, preferably 5–25 wt % is suitable, with the use of lower amounts of salt being anticipated in the presence of the electron transfer agent.

The pH of the solution should be chosen with regard to the particular electron transfer agent and salt used and may also vary with the metals to be removed.

Reaction temperatures will vary with the particular petroleum stream due to its viscosity, and the type of electrolyte and its pH. However, temperatures may suitably range from about ambient to about 700° F. (371° C.), preferably from 100° F. (38° C.) to 300° F. (149° C.), and pressures of from 0 atm (0 kPa) to 210 atm (21,200 kPa), preferably 1 atm (101 kPa) to 3 atm (303 kPa). An increase in temperature may be used to facilitate removal of metal species. Within the process conditions disclosed a liquid or fluid phase or medium should be maintained.

Following demetallation, the product petroleum stream contains a reduced level of metals, e.g., Ni and/or V and/or Fe content. While the actual amount removed will vary according to the starting feed, on average, vanadium levels of not more than about 15 ppm by weight, preferably less than about 4 ppm and on average nickel levels of less than about 10 ppm, preferably less than about 2 ppm can be achieved. Greater than 30 percent by weight of the total vanadium and nickel can thereby be removed.

The metal contaminant-decreased (e.g., upgraded) product may be used in refining operations that are adversely affected by higher levels of metals, for example fluid catalytic cracking or hydroprocessing, or such a product can be blended with other streams of higher or lower metals content to obtain a desired level of metallic contaminants.

A benefit to the present invention is that the process may be operated under ambient temperature and atmospheric pressure, although higher temperature and pressures also may be used as needed. Its most basic form is carried out in an electrochemical cell, by electrolytic means, i.e. in a non-electrostatic mode, as passage of current is required (e.g., relatively low voltage/high current). The cell may be either divided or undivided. Such systems include stirred batch or flow through reactors. The foregoing may be purchased commercially or made using technology known in the art. The cathodic voltage will vary depending on the metal to be removed and the electron transfer agent. The cathodic voltage is in the range 0 to −3.0 V versus Saturated Calomel Electrode (SCE), preferably −1.0 to −2.5 V based on the characteristics of the particular petroleum fraction. While direct current is typically used, electrode performance may be enhanced using alternating current, or other voltage/current waveforms.

One embodiment of the electrochemical process of the present invention (represented in FIG. 1) is carried out in an electrochemical cell on a hydrocarbon soluble metals-containing petroleum stream, in contact with an aqueous electrolysis medium containing at least one electrolyte salt and electron transfer agent preferentially soluble in the aqueous medium in which a voltage is applied to oppositely charged cathodes and anodes in the electrochemical cell. After treatment the upgraded (demetallated) petroleum stream is separated from the aqueous electrolysis medium and the metals are removed from the aqueous electrolysis medium before recycle of the aqueous electrolysis medium to treat additional metals-containing petroleum feed. Thus, in the first embodiment the metals containing petroleum stream and aqueous electrolysis medium containing the electrolyte salt and electron transfer agent are combined and subjected to application of a suitable cathodic voltage to produce demetallation. FIG. 1 exemplifies this embodiment.

In another embodiment of the process of the present invention the aqueous electrolysis medium (containing the electron transfer agent) is subjected to separate electrochemical treatment in an electrochemical cell in which a voltage is applied to oppositely charged electrodes to produce a reduced electron transfer agent (i.e., in an electrochemical reduction step). The electrochemically pretreated aqueous electrolysis medium containing the electrolyte salt and reduced electron transfer agent is then contacted with the metals containing petroleum stream to form an oil-in-water dispersion for a time and at conditions sufficient to produce a treated petroleum stream having a decreased metals content. The upgraded (i.e., demetallated) petroleum stream can be separated from the aqueous electrolysis medium containing the electrolyte salt and oxidized electron transfer agent and the aqueous electrolysis medium recycled to the electrochemical treatment step. Beneficially in this embodiment the petroleum stream does not contact the anode and cathode (i.e., demetallation treatment occurs separately from the electrochemical treatment step). FIG. 2 exemplifies this emodiment.

BRIEF DESCRIPTION OF THE DRAWINGS

FIG. 1 represents one embodiment of the process of the present invention. In FIG. 1 the metals containing petroleum stream (1) and the aqueous electrolysis medium containing the electron transfer agent and salt (5) are contacted in Contactor, A. This contacting may be achieved by such devices as in-line static mixers, a mixing tank, a sonication mixer, etc. The resultant oil-in-water dispersion (2) of fine oil droplets dispersed in the aqueous electrolysis medium is then passed to electrolyzer, B, in which the electrochemical demetallation is conducted. A variety of devices can be used, ranging from a single continuously stirred tank (CSTR) type electrochemical cell to a cascade of plug flow electrolyzers. Recirculation of stream (3) through step B (not shown in Figure) may be required to achieve desired levels of demetallation and would be considered a process optimization. The electrolyzer, B, consists of at least one cathode and anode arranged appropriately to achieve passage of electric current at suitable cathodic potentials and to result in the demetallation of the petroleum stream. Treated stream (3) exiting electrolyzer, B, is an oil-in-water dispersion in which the oil component has a decreased metals content. The stream (3) is passed to at least one separator, C, in which the oil and aqueous electrolyte phases are separated. This step could be achieved in a variety of ways: with a large holding tank, a gravity settler/coaleser, an electrostatic coalescer, etc. The demetallated petroleum stream (4) may be passed on for further processing in the refinery. The aqueous electrolyte stream (5) still containing the salt and electron transfer reagent is recycled back to contctor A for mixing with additional metals containing petroleum stream. Optional separator, D, is included to indicate that the metals removed from the petroleum stream may be recovered from the aqueous phase by conventional methods such as precipitation, flocculation, filtration, or electrochemical plating. Stream 6 represents only a small fraction of the total recirculating electrolyte in stream (6) and as such is actually a purge stream. Addition of a make-up stream of fresh electrolyte and electron transfer agent to maintain a steady-state performance would be considered a process optimization.

FIG. 2 represents a second embodiment of the process of the present invention. The feed to the process is the same as in FIG. 1, i.e., a metals containing petroleum stream (1). A is a mixer but this time, the aqueous electrolysis medium containing the salt and electron transfer agent (4) is electrochemically pretreated in the electrolyzer, C, and exits as stream 6 which is the aqueous electrolysis medium containing salt and electrochemically-reduced electron transfer agent. Treatment in the electrolyzer, C, produces an electron transfer reagent that is reduced, that is, has accepted electrons at the cathode (and can transfer these electrons to acceptor molecules in the petroleum stream upon mixing). In FIG. 1 above, by contrast, the electron transfer agent is first mixed with the petroleum stream and then both the aqueous electrolysis medium and petroleum phases are subjected to electrochemical treatment. In the alternative embodiment in FIG. 2, only the aqueous electrolyte stream is subjected to direct electrochemical reduction in electrolyzer, C. By eliminating passage of petroleum stream through electrolyzer C, improvement in electrode lifetime and elimination of electrode fouling are anticipated. The potentially smaller size of the aqueous electrolysis medium stream (4) relative to the oil-in-water dispersion stream (2) could also offer opportunities for more compact and less costly electrolyzer C. In FIG. 2, stream (2) is an oil-in-water dispersion in which the petroleum stream has undergone indirect reduction and demetallation by contact with the pre-reduced electron transfer agent. In Separator B (equivalent to C in FIG. 1) the demetallated petroleum stream (3) is separated from the aqueous electrolysis medium stream (4) which is recycled through the electrolyzer C. In stream (4) the electron transfer agent is in its oxidized form and can again accept electrons by passage through electrolyzer, C. In stream (5) the electron transfer agent is in its reduced form and can donate electrons to the petroleum stream (1) in contactor A. Stream 6 and Separator D are as in FIG. 1.

Figure 1:
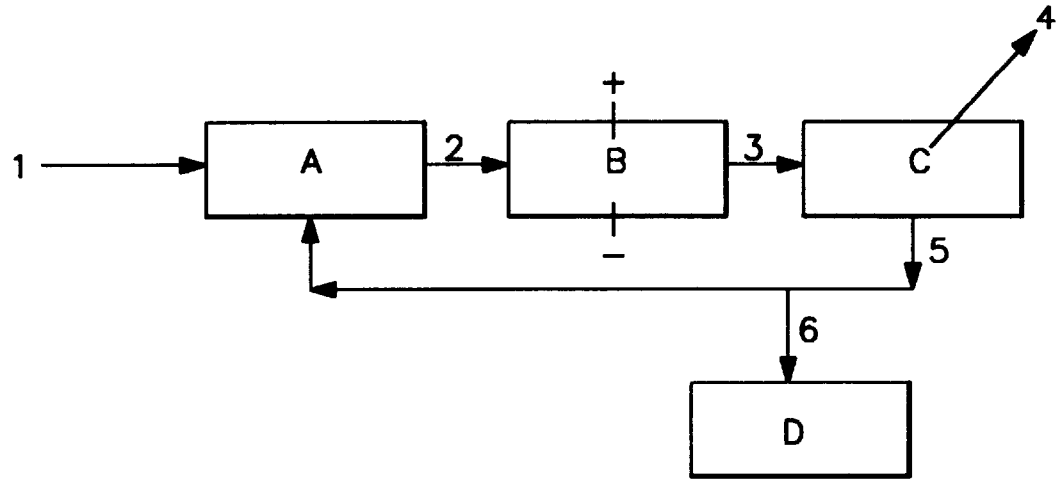
In FIGS. 1 & 2, the lettered boxes designate process steps and the numbered arrows designate process streams representing embodiments of the present invention.
Figure 2:
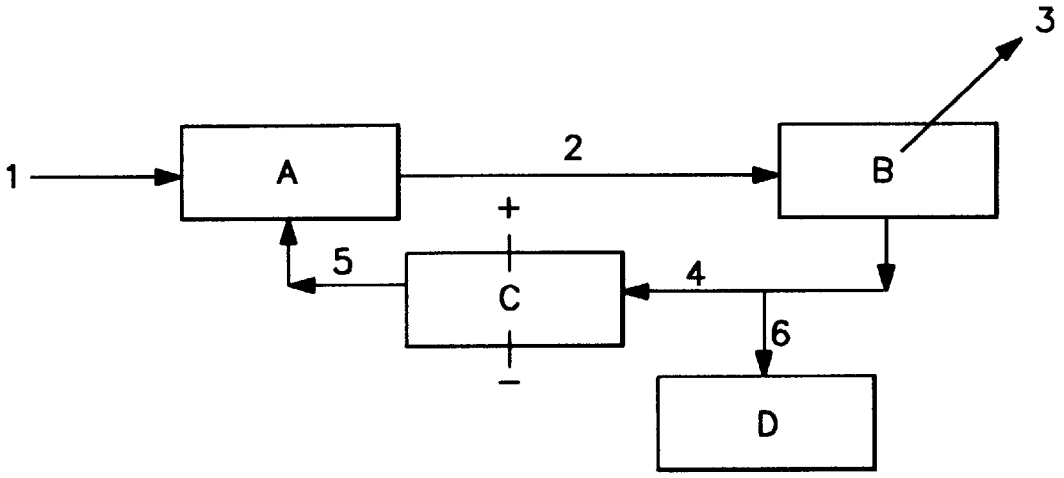

What is claimed is:

1. A process for demetallating a petroleum stream, comprising:

applying to an oil in water dispersion of a hydrocarbon soluble metals-containing petroleum stream and an aqueous electrolysis medium containing at least one electron transfer agent and at least one redox-stable electroconductive salt a sufficient electric current to produce a petroleum stream having a decreased metals content.

2. The process of claim 1 wherein the electron transfer agent is selected from organic species and metal complexes capable of undergoing reversible electrochemical reduction-oxidation.

3. The process of claim 1 wherein the electric current is at a cathodic voltage of 0 to −3.0 V vs. SCE.

4. A process for demetallating a petroleum stream, comprising:

(a) contacting an aqueous electrolysis medium containing at least one electron transfer agent capable of undergoing reversible electrochemical redox and at least one electronconductive salt with a sufficient electrical current to produce a treated aqueous electrolysis medium containing a reduced electron transfer agent;

(b) contacting the treated aqueous electrolysis medium of step (a) with a metals-containing petroleum stream for a time sufficient to produce a petroleum stream having a decreased metals content.

5. The process of claim 4 wherein the electric current is at a cathodic voltage of from 0 to −3.0 V vs. SCE.

6. The process of claim 4, wherein the contacting of step (b) produces an oil-in-water dispersion of the metals-containing petroleum stream in the aqueous electrolysis medium.

7. The process of claim 4, wherein the contacting of step (b) results in the production of oxidized electron transfer agent in the aqueous electrolysis medium.

8. The process of claim 4, further comprising recovering and treating the aqueous electrolysis medium containing the electron transfer agent and electroconductive salt to regenerate the reduced electron transfer agent.

9. The process of claim 4, further comprising recycling the aqueous electrolysis medium to treat an additional metals containing petroleum stream.

* * * * *